United States Patent [19]

Koizumi et al.

[11] Patent Number: 4,818,845

[45] Date of Patent: Apr. 4, 1989

[54] STORAGE TYPE ELECTRIC WATER HEATER HAVING A CLOSED CIRCULATION LOOP PROVIDED WITH A BUBBLE PUMP

[75] Inventors: Hisao Koizumi, Zushi; Yoshihisa Oishi, Yokohama, both of Japan

[73] Assignee: Kabushiki Kaisha Toshiba, Kawasaki, Japan

[21] Appl. No.: 69,229

[22] Filed: Jul. 2, 1987

[30] Foreign Application Priority Data

Jul. 3, 1986 [JP] Japan ..... 61-154978

[51] Int. Cl.[4] ..... H05B 1/02; F24J 2/00; F24H 1/18; F24H 1/10

[52] U.S. Cl. ..... 219/314; 126/362; 219/297; 219/306; 219/316; 219/334; 417/208

[58] Field of Search ..... 219/280–283, 219/296–312, 314–338; 126/362, 351, 361; 417/207–209

[56] References Cited

U.S. PATENT DOCUMENTS

| | | | |
|---|---|---|---|
| 1,173,759 | 2/1916 | Williams | 126/362 |
| 1,269,053 | 6/1918 | Clark et al. | 219/321 |
| 1,535,101 | 4/1925 | Christian | 219/334 |
| 1,671,584 | 5/1928 | Hicks et al. | 219/321 X |
| 1,717,207 | 6/1929 | Halle | 219/314 |
| 1,791,095 | 2/1931 | Hicks | 219/314 |
| 1,809,077 | 6/1931 | Shuman | 219/299 |
| 2,105,893 | 1/1938 | Salmonsen | 219/297 X |
| 2,440,610 | 4/1948 | Kimberlin | 219/306 X |
| 2,493,175 | 1/1950 | Weinman | 219/314 |
| 2,514,485 | 7/1950 | Goff | 219/328 X |
| 2,519,920 | 8/1950 | Miner | 126/362 X |
| 2,926,234 | 2/1960 | Palmer | 219/328 X |
| 3,087,438 | 4/1963 | Ciesielski | 417/207 |
| 3,400,246 | 9/1968 | Zob | 219/297 |
| 4,197,446 | 4/1980 | Kalmanoviz | 219/297 |
| 4,328,791 | 5/1982 | Moore et al. | 126/427 |

FOREIGN PATENT DOCUMENTS

| | | | |
|---|---|---|---|
| 14956/28 | 8/1929 | Australia | 219/316 |
| 41739 | 3/1984 | Japan | 219/297 |

*Primary Examiner*—Anthony Bartis

*Attorney, Agent, or Firm*—Oblon, Fisher, Spivak, McClelland & Maier

[57] ABSTRACT

An electric storage type water heater includes a tank having cold water introduced into the lower part thereof and an upper part connected by a hot water supply pipe to a faucet. A bubble pump arranged within an external heat insulator layer enclosing the tank includes a connection pipe connecting the upper and lower parts of the tank and forming a closed circulation loop in cooperation therewith. The connection pipe has a vertically extending intermediate pipe section closed at its lower end and having its upper end and an axially intermediate portion connected to the upper and lower parts of the tank, respectively, by upper and lower pipe sections. An electric heater associated with the intermediate pipe section heats the water therein to cause circulation through the closed loop. Check valves in the upper and lower pipe sections allow water to flow only in a direction from the lower part to the upper part of the tank.

14 Claims, 7 Drawing Sheets

STORAGE TYPE ELECTRIC WATER HEATER HAVING A CLOSED CIRCULATION LOOP PROVIDED WITH A BUBBLE PUMP

BACKGROUND OF THE INVENTION

The present invention relates to a storage type electric water heater.

Electric water heaters are classified into two types, i.e., the instantaneous type and storage type. In the instantaneous type, an electric heater capable of providing great heating power is used, so that water is instantaneously heated to a desired temperature. On the other hand, in the storage type water heater, water heated to a desired temperature is beforehand stored in the water tank and discharged when required. The instantaneous type water heater requires an electric heater having great heating power, e.g., 5–20 kw., so that it can supply a sufficient amount of hot water. The storage type water heater is therefore chiefly used in ordinary houses.

The storage type electric water heater includes a water tank, the outer peripheral surface of which is covered with a heat insulator. The lower part of the water tank is connected to a cold water supply pipe, and the upper part of the same is connected to faucets through a hot water supply pipe. A sheathed electric heater is arranged at the lower part of the water tank. The electric heater is supplied with an electric current during a period in which hot water is seldom used, e.g., midnight hours, so that water in the water tank is in its entirety heated to, e.g., 80° C. overnight. There are two ways for supplying an electric current to the electric heater: first, the supply of electric current to the heater is started at any necessary time and stopped when the temperature of water in the tank reaches a desired level; and secondly, the supply of electric current to the heater is started in midnight hours in which the user is charged less for the use of electricity, and stopped when the temperature of the water reaches a desired level. The latter (i.e., midnight power supply) is widely used for the purpose of economy. The water heater of this type includes a timer switch which is operated at a preset time of a day for control of the power supply to the electric heater. The timer switch is kept under control of the electric power company, so that the user may not manipulate the timer switch.

The storage type electric water heater, however, has the following problems. In the water heater of the first-mentioned power supply type, for example, when an electric current is supplied to the heater, the temperature of water in the water tank rises slowly because of natural convection. In this case, an increase in temperature of the water with respect to time depends upon the heating power of the electric heater and the capacity of the water tank. However, as stated above, it is not desirable to use an electric heater having great heating power in ordinary household appliances. On the other hand, in order to make full use of the storage type water heater, the water tank should desirably have a capacity of at least hundreds of liters. For this reason, the temperature of water in the water tank does not increase rapidly. When the temperature of the water reaches a desired level, e.g., 80° C., the supply of electric current to the heater is stopped. Obviously, the electric water heater of the first-mentioned power supply type requires a longer time for increasing the temperature of the water to a level suitable for use (e.g., 80° C.), thus failing to meet the requirement of high responsiveness. Further, as will be understood from the above, the water in the tank is in its entirety heated to the preset level (i.e., 80° C.), regardless of the amount of water actually required. Therefore, if the necessary amount of water is 100 liters, and the water tank has a capacity of 300 liters, electric power is consumed wastefully by an amount required to increase the temperature of 200-liter water to 80° C. This is the case with the electric water heater of the midnight power supply type. The water heater of the midnight power supply type employs a water tank having a great capacity, since the power supply period is fixed, and it is necessary to prevent hot water from running short during the daytime. Therefore, greater space is required for the water tank, and electric power is often consumed wastefully. Thus, the conventional electric water heater of the midnight power supply type can supply hot water of 80° C. at any time in the daytime without delay, since water is heated and stored overnight. However, when the hot water is used up, the heater becomes useless.

Thus, with the conventional storage type electric water heater, it is not possible to quickly store a desired amount of hot water of, e.g., 80° C., at a desired time. The conventional water heater has poor responsiveness and usability, and is likely to consume electric power wastefully.

SUMMARY OF THE INVENTION

The object of the invention is to provide an electric water heater of a storage type, which is simple in construction, making it unnecessary to use an electric heater having great heating power, and capable of storing in a water tank a water stratum of a desired thickness and temperature by thermal stratification, thereby fully meeting the requirements of economy and high responsiveness.

According to the present invention, a bubble pump is provided for connecting the upper part of the water tank to the lower part of the same. The bubble pump includes a connection pipe connecting the upper part of the water tank to the lower part of the same, thereby forming a closed loop in cooperation with the water tank, an electric heater for heating water located in a specific region of the connection pipe, and a pair of check valves arranged in the connection pipe before and after the specific region of the same, so as to allow water to flow only in a direction from the lower part of the water tank to the upper part of the same. The supply of electric current to the electric heater is controlled by a power controller.

When the electric heater is supplied with an electric current, part of the water in the specific region of the connection pipe boils and condenses alternately. When the water boils, hot water of, e.g., 80° C., is supplied to the upper part of the water tank through the check valve arranged in the vicinity of the upper part of the tank. On the other hand, when the water in the specific region condenses, cold water flows from the lower part of the water tank to the specific region of the connection pipe through the check valve arranged in the vicinity of the lower part of the tank. These processes are carried out repeatedly. As a result, a stratum of 80° C. water is stored in the upper part of the water tank. The thickness of the water stratum expands downward as the operation of the water heater continues. When the supply of electric current to the electric heater stops, the stratum of 80° C. water remains in the upper part of the water tank, due to thermal stratification. Therefore, by suitably selecting the time for which an electric current is supplied to the electric heater, a desired amount of 80° C. water can be stored in the water tank. Thus, the electric water heater of this invention can achieve high responsiveness, while minimizing wasteful consumption of electric power. Further, a water tank of a smaller size can be used without causing any disadvantage.

DETAILED DESCRIPTION OF THE PREFERRED EMBODIMENTS

Figure 1:
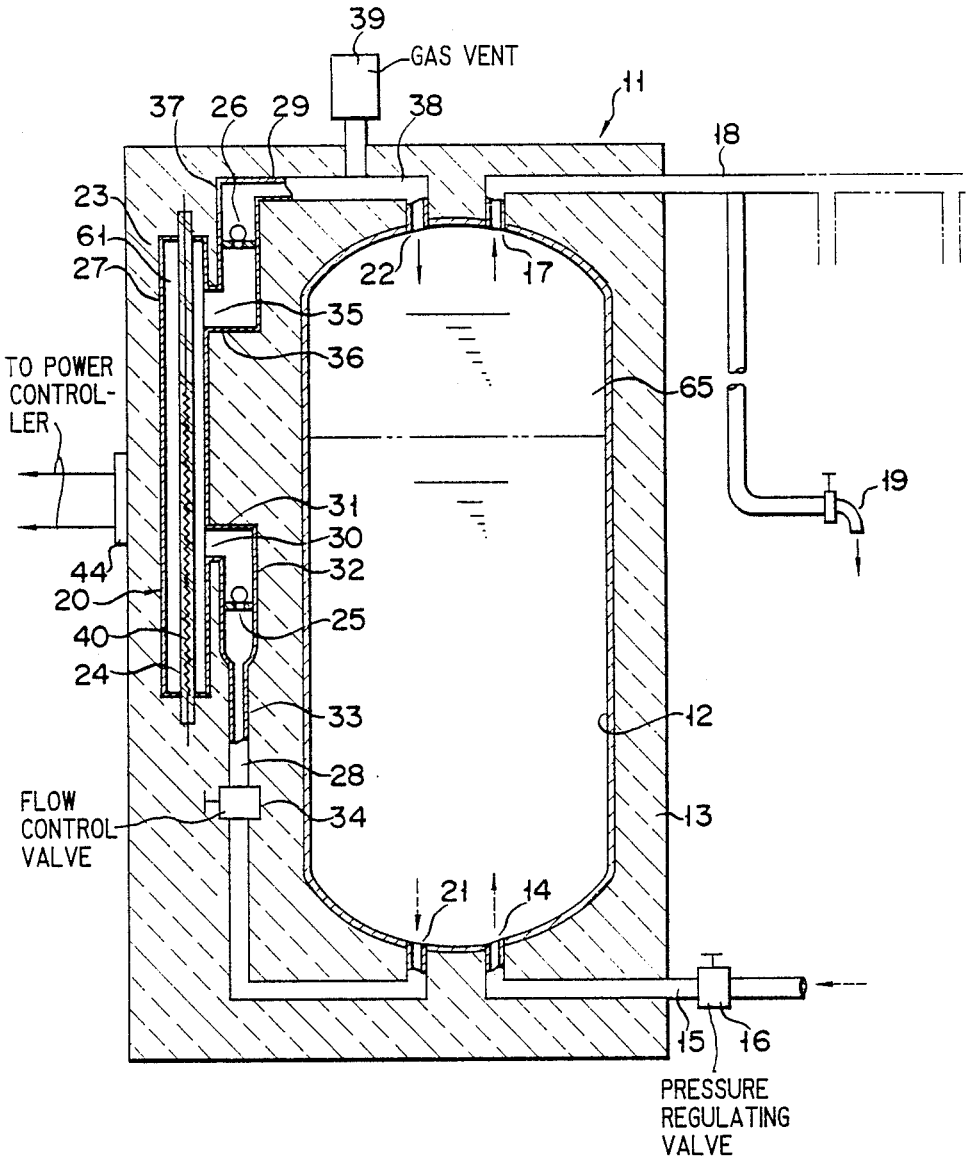
FIG. 1 is a longitudinal sectional view showing an essential part of an electric water heater according to one embodiment of the invention.

FIG. 1 shows essential part 11 of an electric water heater according to the invention.

Essential part 11 includes vertically elongated water tank 12 having a capacity of 300 liters, for example. Water tank 12 is covered with heat insulator 13. Water inlet port 14 is formed in the lower wall portion of water tank 12, for introducing cold water into tank 12. Inlet port 14 is connected to cold water supply pipe 15. Pressure regulating valve 16 is arranged in cold water supply pipe 15, for decreasing the pressure of water to be supplied to water tank 12 to 1 kg/cm$^2$ or less. Hot water outlet port 17 is formed in the upper wall of water tank 12, for supplying hot water in water tank 12 to the outside. Outlet port 17 is connected, through hot water supply pipe 18, to faucets 19 arranged in a kitchen or bathroom.

Bubble pump 20 is embedded in heat insulator 13. Bubble pump 20 is connected at a lower open end to suction port 21 formed in the lower wall of water tank 12, and connected at an upper open end to discharge port formed in the upper wall of water tank 12. Bubble pump 20 includes connection pipe 23 forming a closed loop in cooperation with water tank 12, electric heater 24 for heating water located in a specific region of connection pipe 23, i.e., intermediate region of pipe 23 in the illustrated embodiment, and check valves 25 and 26 arranged in connection pipe 23 before and after the intermediate portion with respect to the flow of water, for allowing water to flow only in a direction from suction port 21 to discharge port 22.

Connection pipe 23 includes intermediate pipe section 27 formed by a stainless steel, copper or aluminum tube having an inner diameter of 25 mm and a length of 70 cm with opposite ends closed and having an axis arranged vertically, lower pipe section 28 connected at one end to a lower intermediate portion of intermediate pipe section 27 and connected at the other end to suction port 21, and upper pipe section 29 connected at one end to an upper intermediate portion of intermediate pipe section 27 and connected at the other end to discharge port 22. Lower pipe section 28 has portion 31 extending horizontally from connection port 30 connecting with intermediate pipe section 27, portion 32 extending downward from portion 31, and portion 33 extending from portion 32 to suction port 21. Flow control valve 34 is arranged in an intermediate part of portion 33. Upper pipe section 29 has portion 36 extending horizontally from connection port 35 connecting with intermediate pipe section 27, portion 37 extending upward from portion 36, and portion 38 extending from portion 37 to discharge port 22. Float type gas vent valve 39 is connected to portion 38.

Electric heater 24 is of a sheath type and has heating power of 2 kw, for example. Nichrome wire 40, coated with an insulating material, is covered with an outer sheath made of metal, thereby forming a rod having an outer diameter of 10 mm. Opposite ends of electric heater 24 project from the upper and lower ends of intermediate pipe section 27 in a liquid-tight fashion. Electric heater 24 is arranged concentrically with intermediate pipe section 27. Nichrome wire 40 is suitably positioned, such that water located between the lower end of intermediate pipe section 27 and connection ports 30 and 35 is heated most.

Figure 2:
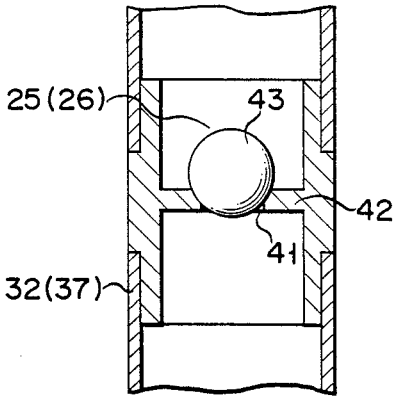
FIG. 2 is a longitudinal sectional view showing a check valve incorporated into the electric water heater of FIG. 1.

Check valve 25 is arranged in portion 32 of lower pipe section 28 and allows water to flow only toward intermediate pipe section 27. Check valve 26 is arranged in portion 37 f upper pipe section 29, so as to allow only the flow of water from intermediate pipe section 27. As shown in FIG. 2, check valves 25 and 26 each include valve seat 42 having valve opening 41 at the center thereof, and ball 43 as a valve body, which is made of a heat-resistant material such as tetrafluoroethylene and placed on valve seat 42 so as to close valve opening 41.

Figure 3:
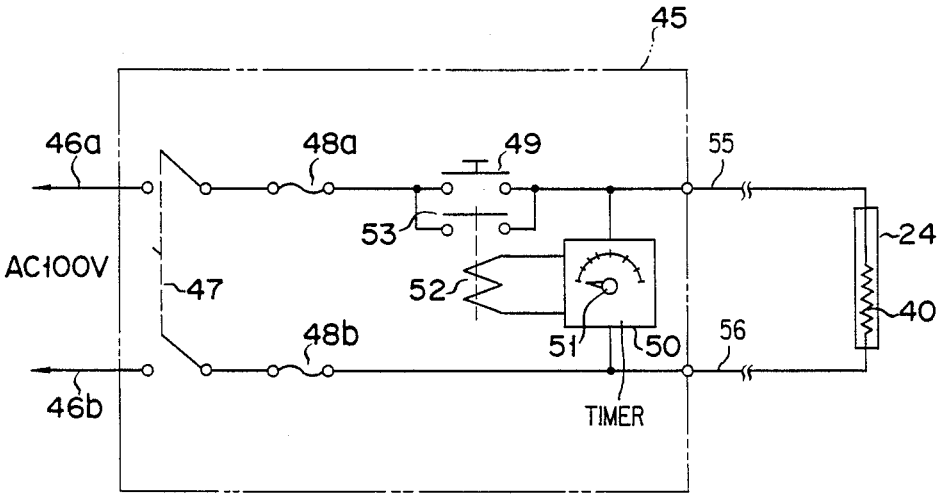
FIG. 3 is a diagram showing electrical connections within a power controller incorporated into the electric water heater of FIG. 1.

Terminal box 44 is arranged outside heat insulator 13. Electric heater 24 has ends connected via terminal box 44 and power supply wires 55, 56 to power controller 45 shown in FIG. 3. Power controller 45 includes timer switch 50, the voltage terminals of which are connected to commercial power supply lines 46*a* and 46*b* via manual switch 47, fuses 48*a* and 48*b* and push-button switch 49. The time of power supply to the electric heater can be set as desired by turning knob 51 of timer switch 50. When a voltage is applied across the voltage terminals of timer switch 50, relay 52 is energized, and when the time as set by knob 51 elapses, the energization of relay 52 is stopped. Normally-open contact 53 of relay 52 is connected in parallel with push-button switch 49. Electric heater 24 is supplied with an electric current from the voltage terminals of timer switch 50.

Now, the operation of the electric water heater constructed as above will be described.

Water tank 12 is filled with cold water, and faucets 19 are closed. In this case, since water remains still, check valves 25 and 26 are both closed. Connection pipe 23 of bubble pump 20 is also filled with cold water.

Figure 4A:
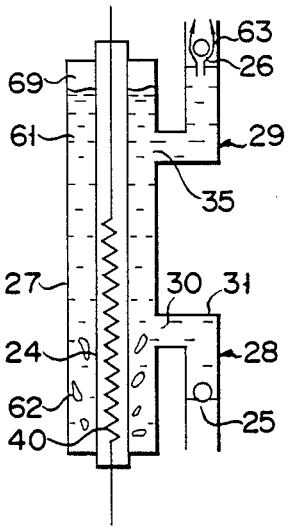
FIGS. 4A and 4B are views for explaining the operation of a bubble pump incorporated into the electric water heater of FIG. 1.
Figure 4B:
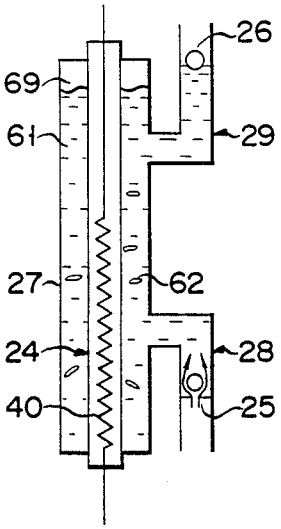

A desired time of power supply to the electric heater is set by turning knob 51 of timer switch 50. Then, after switch 47 is operated, push-button switch 49 is depressed. As a result, the power supply to electric heater 24 is started, and at the same time timer switch 50 operates to energize relay 52. Thus, normally-open contact 53 of relay 52 closes, and the power supply to electric heater 24 continues even if the user stops depressing push-button switch 49 thereafter. As electric heater 24 is supplied with an electric current, water located in intermediate pipe section 27 is heated rapidly. When part of water 61 in intermediate pipe section 27 is heated to the boiling point, steam bubbles 62 are produced, as shown in FIG. 4A. Therefore, the volume of water increases, and the pressure in intermediate pipe section 27 increases. As a result, check valve 26 opens, whereby hot water flows from intermediate pipe section 27 to upper pipe section 29, as indicated by arrows 63 in FIG. 4A. Steam bubbles 62 go upward, and, when they reach in the vicinity of connection port 30 connecting pipe sections 27 and 28, they condense as they are cooled by cold water in portion 31. Therefore, the pressure in intermediate pipe section 27 decreases. When the pressure in intermediate pipe section 27 decreases in this manner, check valve 26 closes, and instead, check valve 25 opens, as shown in FIG. 4B, whereby cold water in the lower part of water tank 12 flows to intermediate pipe section 27 through lower pipe section 28. Due to the supply of cold water, the temperature of intermediate pipe section 27 is further decreased, and accordingly, steam bubbles 62 disappear rapidly. As steam bubbles 62 disappear, the supply of cold water through lower pipe section 28 stops. As a result, the temperature in intermediate pipe section 27 again increases rapidly, and steam bubbles 62 are produced. The operations described above are repeated until the time as set by timer switch 50 elapses. Therefore, hot water (e.g., 80° C.) is intermittently discharged from intermediate pipe section 27.

The hot water thus discharged flows through upper pipe section 29 and discharge port 22 to the upper part of water tank 12. Hot water 65 of 80° C. is stored in the upper part of water tank 12 in the form of a stratum, due to the thermal stratification. The thickness of the hot water stratum can be changed by changing the time for which electric heater 24 is supplied with an electric current, i.e., the time set by timer switch 50.

Figure 5:
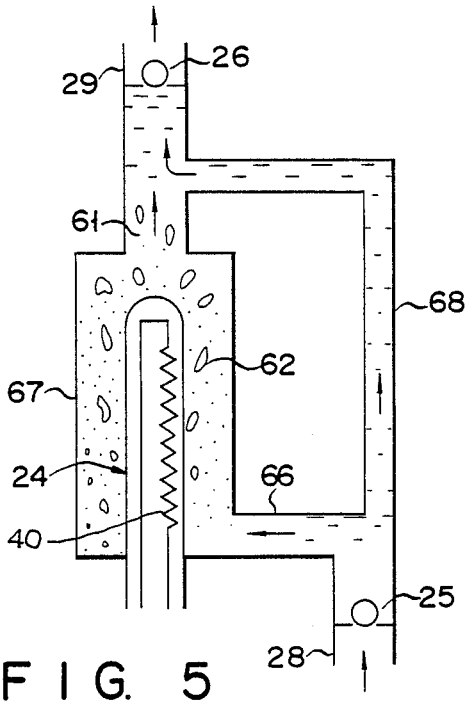
FIG. 5 is a view showing a model for explaining the flow of water in the bubble pump shown in FIG. 4A.

The temperature of water discharged from bubble pump 20 can be adjusted either by operating flow control valve 34 or by changing the axial position of connection port 30 connecting between pipe sections 28 and 27. More specifically, in bubble pump 20 incorporated into the electric water heater shown in FIG. 1, the hot water in the lower portion of intermediate pipe section 27, heated to the saturation temperature, is mixed in a certain ratio with cold water supplied from lower pipe section 28. The resultant water is discharged from upper pipe section 29. FIG. 5 shows a model for explaining the flow of water. Water supplied from lower pipe section 28 flows in part to boiling portion 67 through passage 66. The remaining part of water flows through passage 68 to boiling portion 67 where it is mixed with hot water heated to the saturation temperature. The water thus mixed is discharged to upper pipe section 29. As will be noted from the drawing, changing the position of connection port 30 between intermediate and lower pipe sections 27 and 28 so as to be remote from the lower end of intermediate pipe section 27 is equivalent to making passage 66 narrower and making passage 68 broader. In this case, the temperature of hot water discharged from bubble pump 20 is relatively low. On the other hand, changing the position of connection port 30 so as to be close to the lower end of intermediate pipe section 27 is equivalent to making passage 66 broader and making passage 68 narrower. Thus, the temperature of hot water discharged from pump 20 is relatively high. In this manner, the temperature of hot water can be suitably set by changing the position of connection port 30. As bubble pump 20 is operated by supplying an electric current to electric heater 24, non-condensible gases produced in intermediate pipe section 27 collect in space 69 in FIG. 4A. The gases serve to mitigate the shock caused when the steam condenses. When the gases thus collected reach connection port 35, they flow to upper pipe section 29, together with hot water, and are discharged to the outside through gas vent valve 39.

Figure 6:
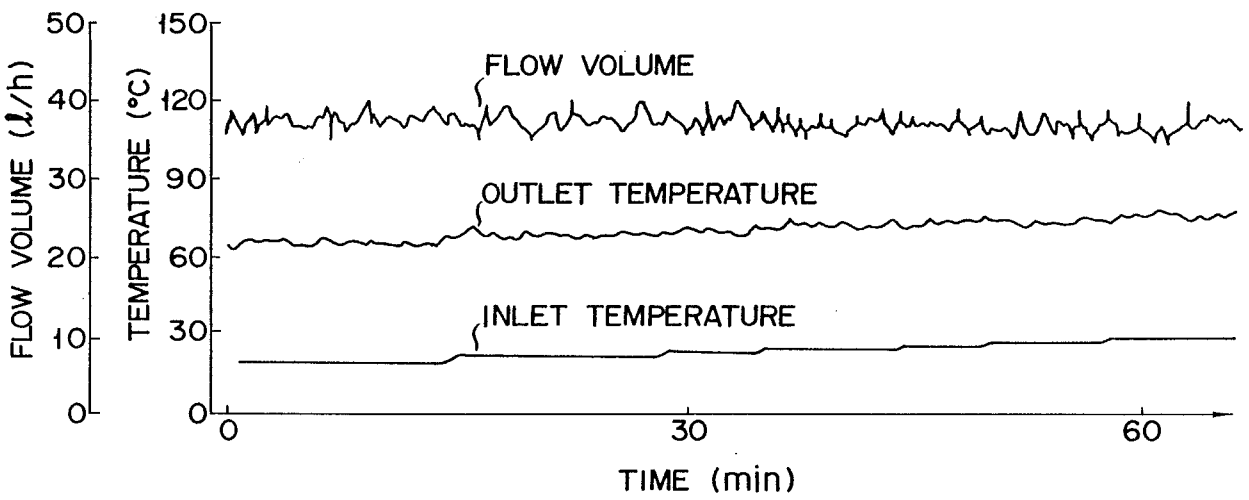
FIG. 6 is a graph showing the operational characteristic of a bubble pump manufactured by way of experiment.

FIG. 6 is an oscillogram showing the results of an experiment conducted by using a bubble pump manufactured by way of experiment. The abscissa represents the lapse of time after the initiation of power supply to electric heater 24. As shown in the figure, the water temperature at the inlet port changes gradually from 22° C. to 30° C., and accordingly, the water temperature at the outlet port changes from 68° C. to 76° C. The flow rate of water is constant as a whole, though it changes slightly.

As will be clear from the above description, the electric water heater of the invention is simple in structure and capable of storing in water tank 12 a necessary amount of hot water stratum kept at a temperature desirable for use, e.g., at 80° C., in a short time and at a desired time. It is therefore possible to reduce wasteful power consumption. Since a desired amount of hot water can be stored in water tank 12 in a short time, it is unnecessary to use a water tank having great capacity. Further, the water heater of the invention does not utilize natural convection, but water is heated as it passes by the electric heater. Thus, heat is transmitted from electric heater 24 to water very efficiently. Therefore, an electric heater having small heating power and small size can be used. The operation described above is carried out without the use of elements that are shortly abraded or require a complicated structure, whereby the water heater can operate reliably for a long period of time.

Figure 7:
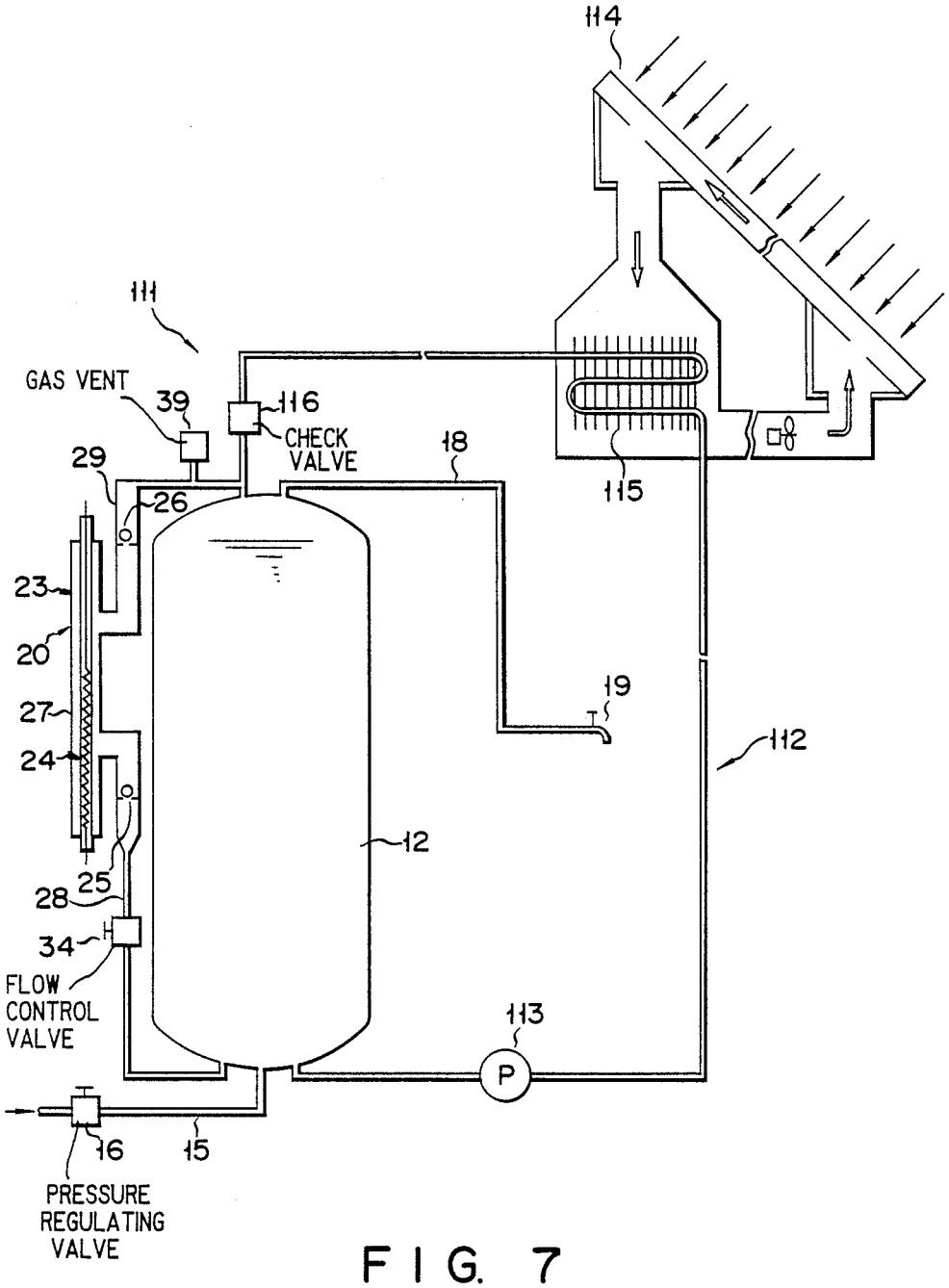
FIG. 7 is a view schematically showing a construction of an essential part of an electric water heater according to another embodiment of the invention.

Next, the structure of essential part 111 of an electric water heater according to another embodiment of the invention will be described with reference to FIG. 7. FIG. 7 schematically shows the essential part of the electric water heater. The same reference numerals as used in FIG. 1 are generally used to refer to corresponding or similar parts in this embodiment.

The electric water heater of this embodiment differs from that shown in FIG. 1 in that solar heating line 112 connected in parallel with bubble pump 20 is used. In the water heater using solar heating line 112, water in the lower part of water tank 12 is sucked up by pump 113, and then is returned to the upper part of water tank 12 through heat exchanger 115 which exchanges heat between water and hot air obtained by solar heat collector 114 of the known forced air circulation type, and through check valve 116.

In this electric water heater, water in water tank 12 is heated by solar heating line 112 during sunshine hours, which leads to a reduction in operation time of bubble pump 20. Therefore, one power consumption can be further reduced.

Figure 8A:
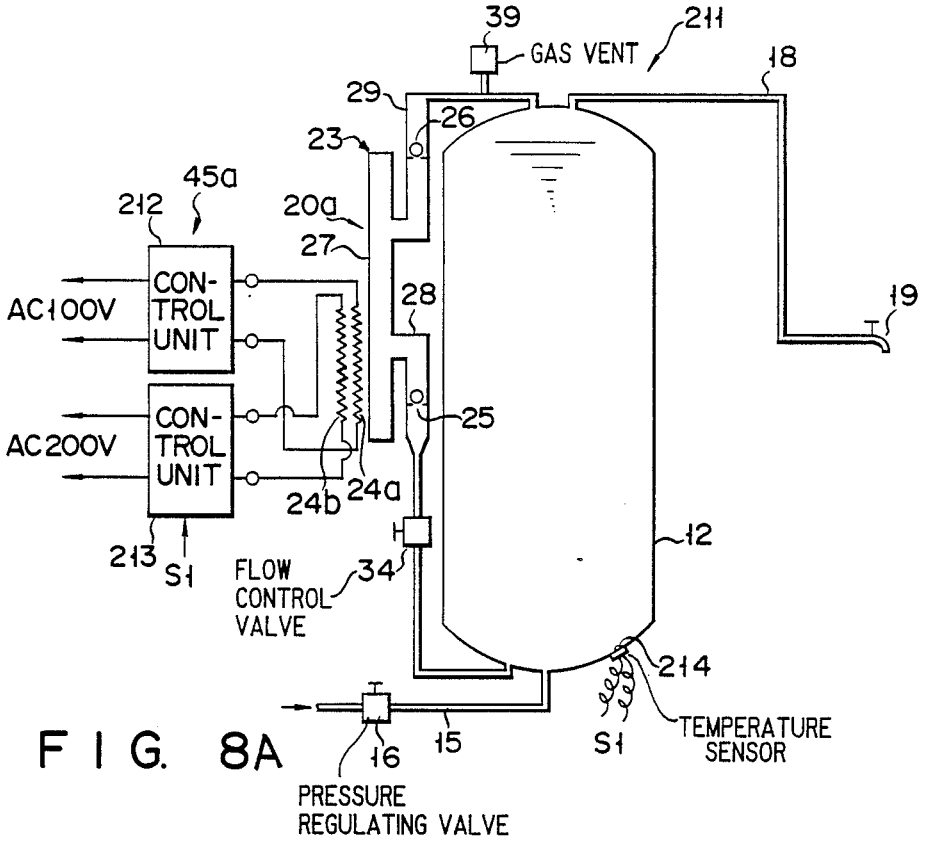
FIG. 8A is a view schematically showing a construction of an electric water heater according to still another embodiment of the invention.

Referring to FIG. 8A, electric water heater 211 according to still another embodiment of the invention will be described. FIG. 8A schematically shows the whole construction of the water heater. The same reference numerals as used in FIG. 1 are generally used to refer to corresponding or similar parts in this embodiment.

Electric water heater 211 in FIG. 8A differs from that shown in FIG. 1 or FIG. 7 in the construction of the bubble pump and power controller.

More specifically, bubble pump 20*a* includes first and second electric heaters 24*a* and 24*b* for heating water in intermediate pipe section 27. The other parts of the electric water heater are constructed in the same manner as the water heater shown in FIG. 1. Power controller 45*a* includes first power control unit 212 for controlling the power supply to first electric heater 24*a*, and second power control unit 213 for controlling the power supply to second electric heater 24*b*. First power control unit 212 is designed to heat water at any necessary time and has a structure similar to that of the power control unit shown in FIG. 3. Second power control unit 213 operates to heat water only during midnight hours in which electric power is available at a lower rate. That is, second power unit 213 is constituted by a combination of a timer and switches and starts supplying an electric current to electric heater 24*b* at a preset time of a day, e.g., 11 p.m. Second power control unit 213 is supplied with the output of temperature sensor 214 arranged at the bottom of water tank 12, so that it stops the power supply to electric heater 24*b* when the temperature of water in the lower part of water tank 12 reaches 80° C., for example.

Figure 8B:
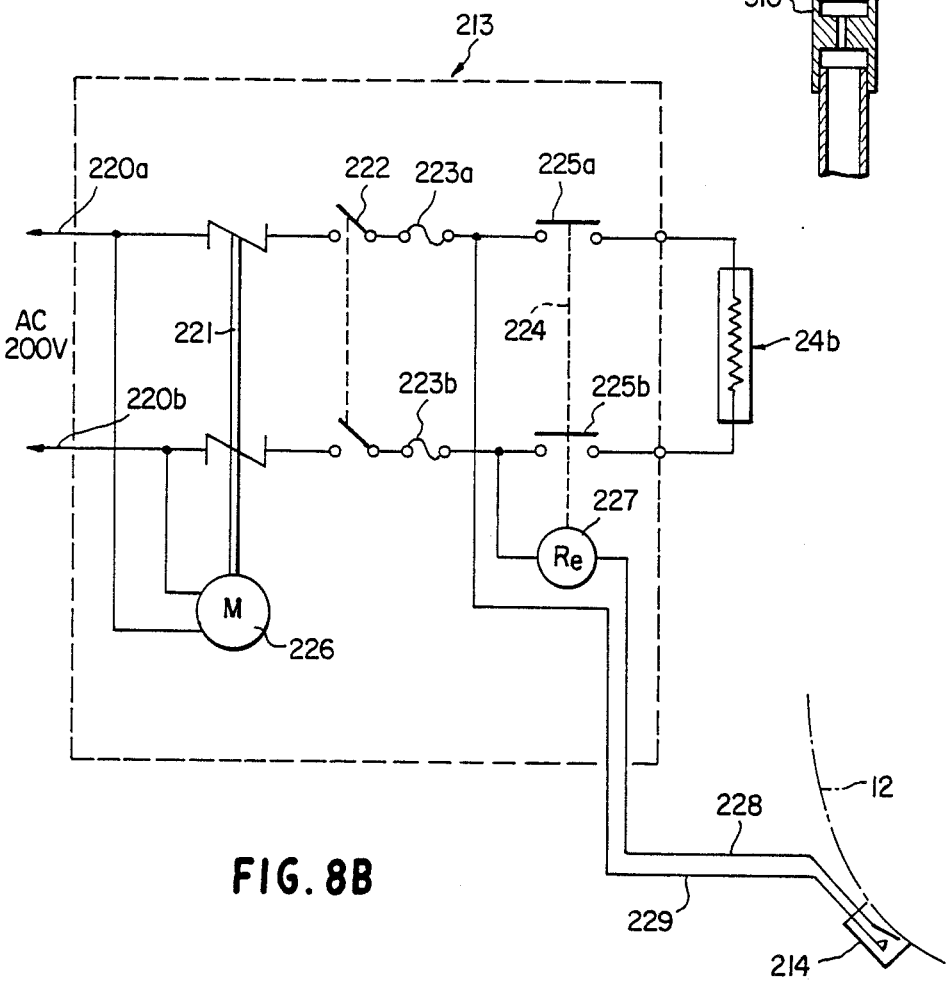
FIG. 8B shows an electric circuit arrangement of a second power control unit incorporated into the electric water heater of FIG. 8A

Power control unit 213 is of the same type as a known power supply system usable during mid-night hours and based on the "less-charge" concept. That is, as shown in FIG. 8B, power source lines 220*a* and 220*b* for use at midnight hours only are connected across electric heater 24*b* through cam switch 221 serving as a timer, manual operation type switch 222, fuses 223*a*, 223*b* and normally-ON contacts 225*a*, 225*b* in relay 224. Cam switch 221 receives a rotation drive force at all times from motor 226 and makes just one complete rotation in 24 hours. Cam switch 221 is turned ON at, for example, eleven o'clock at night and OFF at, for example, four o'clock in the morning by setting the cam to the corresponding position. Cam switch 221 and motor 226 are placed under control of the electric power company and cannot be accessed by the hand of the user. Coil 227 in relay 224 is connected at one end to an input-side fixed terminal of contact 225*a* via lead wire 228, temperature sensor 214 and lead wire 229 in which case sensor 214 is constituted by a thermoswitch which, when the temperature of water in water tank 12 is at a level less than 80° C., is rendered normally ON in response to that temperature level. Thus during the time period corresponding to the ON state of cam switch 221, electric heater 24*b* is energized when the thermoswitch is placed in the ON state.

With the structure described above, an amount of 80° C. hot water equal to the capacity of water tank 12 can be stored in tank 12 every day, by using electric power during midnight hours. When the hot water in water tank 12 is used up in the daytime, first power control unit 212 may be operated so as to supply an electric current to first electric heater 24*a*, whereby a necessary amount of hot water is stored in water tank 12 in a short time.

Figure 9:
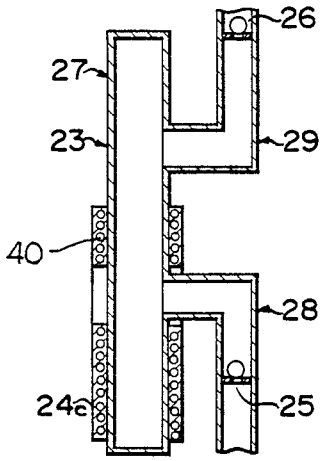
FIG. 9 is a longitudinal sectional view of a bubble pump according to a first modification.

The present invention is not limited to the embodiments described above. Although, in the foregoing embodiments, the electric heater is arranged within the intermediate pipe section, it may be attached to the outer peripheral surface of intermediate pipe section 27 with an insulating material interposed therebetween, as shown in FIG. 9, such that water is indirectly heated by electric heater 24*c* through the wall of intermediate pipe section 27.

Figure 10:
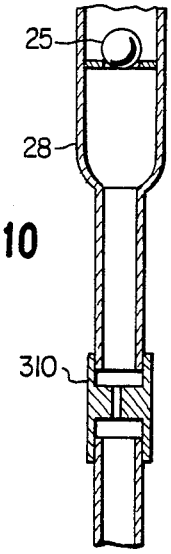
FIG. 10 is a longitudinal sectional view of part of a bubble pump according to a third modification.

The structure of the bubble pump may also be modified. Although, in the foregoing embodiments, the flow control valve is arranged in the lower pipe section of he bubble pump, choke tube 310 having a small inner diameter may alternatively be arranged in lower pipe section 28, as shown in FIG. 10, so as to control the flow of water. Further, the solar heating line shown in FIG. 7 may be additionally provided for the electric water heater shown in FIG. 8A.

What is claimed is:

1. An electric water heater comprising:

a water tank;

a heat insulator covering the water tank;

a cold water supply pipe for introducing cold water into the water tank from a lower part of the same;

a hot water supply pipe connecting an upper part of the water tank to a faucet;

a bubble pump arranged within the heat insulator, bubble pump including:

a connection pipe including an intermediate pipe section closed at a lower end and vertically extending along its axis, a lower pipe section connecting an axially intermediate portion of the intermediate pipe section to the lower part of the water tank, and an upper pipe section connecting an upper portion of the intermediate pipe section to the upper part of the water tank, an electric heater for heating water located in the intermediate pipe section, and a pair of check valves arranged respectively in the lower pipe section and in the upper pipe section, for allowing water to flow only in a direction from the lower part of the water tank to the upper part of the same; and a power controller for controlling the supply of electric current to the electric heater.

2. An electric water heater according to claim 1, wherein said lower pipe section has a flow control valve arranged therein.

3. An electric water heater according to claim 1, wherein each of said paired check valves includes an annular valve seat having an opening at the center thereof, and a ball placed on the valve seat so as to close the opening.

4. An electric water heater according to claim 3, wherein said ball is made of heat-resistant plastic.

5. An electric water heater according to claim 1, wherein said electric heater is inserted through said intermediate pipe section and electrically insulated.

6. An electric water heater according to claim 1, wherein said electric heater is attached to an outer surface of said intermediate pipe section.

7. An electric water heater according to claim 1, wherein said power controller includes a timer circuit by which a power supply time is set as desired, a switch, and a circuit for supplying an electric current to said electric heater upon operation of the switch until the time as set by the timer circuit elapses.

8. An electric water heater according to claim 1, wherein said upper and lower parts of said water tank are connected to a solar heating line.

9. An electric water heater comprising:

a water tank;

a heat insulator covering the water tank;

a cold water supply pipe for introducing cold water into the water tank from a lower part of the same;

a hot water supply pipe connecting an upper part of the water tank to a faucet;

a bubble pump arranged within the heat insulator, the bubble pump including a connection pipe including an intermediate pipe section closed at a lower end and vertically extending along its axis, a lower pipe section connecting an axially intermediate portion of the intermediate pipe section to the lower part of the water tank, and an upper pipe section connecting an upper portion of the intermediate pipe section to the upper part of the water tank, first and second electric heaters for heating water located in said intermediate pipe section, and a pair of check valves arranged respectively in said lower pipe section and in said upper pipe section, for allowing water to flow only in a direction from the lower part of the water tank to the upper part of the same;

a temperature sensor for detecting the temperature of water in the lower part of the water tank;

a first power controller including means for automatically starting the supply of electric current to the first electric heater at a predetermined time of a day, and means for automatically stopping the supply of electric current to the first electric heater in response to the temperature detected by the temperature sensor reaching a predetermined value; and a second power controller arranged independent of said first power controller for controlling the supply of electric current to the second electric heater.

10. An electric water heater according to claim 9, wherein said lower pipe section has a flow control valve arranged therein.

11. An electric water heater according to claim 9, wherein each of said paired check valves includes an annular valve seat having an opening at the center thereof, and a ball placed on the valve seat so as to close the opening.

12. An electric water heater according to claim 11, wherein said ball is made of heat-resistant plastic.

13. An electric water heater according to claim 9, wherein the first and second electric heaters are attached to an outer surface of the said intermediate pipe section.

14. An electric water heater according to claim 9, wherein said second power controller includes a timer circuit by which a power supply time is set as desired, a switch, and a circuit for supplying an electric current tot he second electric heater upon operation of the switch until the time as set by the timer circuit elapses.

* * * * *